US009786421B2

(12) United States Patent
Meinke et al.

(10) Patent No.: US 9,786,421 B2
(45) Date of Patent: Oct. 10, 2017

(54) SEGMENTATION OF WINDING SUPPORT STRUCTURES

(71) Applicant: Advanced Magnet Lab, Inc., Palm Bay, FL (US)

(72) Inventors: Rainer Meinke, Melbourne, FL (US); Gerald M Stelzer, Palm Bay, FL (US)

(73) Assignee: Advanced Magnet Lab, Inc., Palm Bay, FL (US)

( * ) Notice: Subject to any disclaimer, the term of this patent is extended or adjusted under 35 U.S.C. 154(b) by 197 days.

(21) Appl. No.: 14/862,150

(22) Filed: Sep. 22, 2015

(65) Prior Publication Data

US 2016/0086724 A1 Mar. 24, 2016

Related U.S. Application Data

(60) Provisional application No. 62/053,360, filed on Sep. 22, 2014.

(51) Int. Cl.

| | |
|---|---|
| ***H01F 27/30*** | (2006.01) |
| ***H01F 27/28*** | (2006.01) |
| ***H01F 27/29*** | (2006.01) |
| ***H01F 6/06*** | (2006.01) |
| ***H01F 5/02*** | (2006.01) |

(52) U.S. Cl.
CPC *H01F 6/06* (2013.01); *H01F 5/02* (2013.01)

(58) Field of Classification Search
USPC ..... 336/208, 223, 225, 222, 224.192
See application file for complete search history.

(56) References Cited

U.S. PATENT DOCUMENTS

| | | | | |
|---|---|---|---|---|
| 2,982,888 | A * | 5/1961 | Whearley | H01F 5/02 174/120 R |
| 7,405,361 | B1 * | 7/2008 | Lester | H02G 3/0481 174/135 |
| 8,307,536 | B2 * | 11/2012 | Debray | H01F 7/202 29/602.1 |
| 2009/0206974 | A1 * | 8/2009 | Meinke | H01F 5/00 336/224 |
| 2009/0251257 | A1 * | 10/2009 | Stelzer | G01R 33/3802 335/300 |
| 2013/0038331 | A1 * | 2/2013 | Debray | H01F 7/202 324/322 |

* cited by examiner

*Primary Examiner* — Tsz Chan
*Assistant Examiner* — Kazi Hossain
(74) *Attorney, Agent, or Firm* — Stephen C. Thomas

(57) ABSTRACT

The present invention provides a method of manufacturing magnets, including magnets comprising coil windings which may be multiple meters in length. In an embodiment, the support structure comprises a cylinder in which machined grooves are formed to define the magnet conductor path. The segments may consist of a composite material or a metal in the shape of a cylinder, but which need not be manufactured from a single piece of material. Rather, the support structure may be formed in multiple connectable segments which, when connected together, form a completed wiring support structure. Each segment may be of sufficient length to support multiple individual coil turns in a helical configuration. When the segments are connected the helical configuration continues without interruption from connectable segment to connectable segment. The segmented wiring support structure of the invention may be applied to linear or curved magnet geometries.

24 Claims, 8 Drawing Sheets

SEGMENTATION OF WINDING SUPPORT STRUCTURES

CROSS REFERENCE TO RELATED APPLICATIONS AND INCORPORATION BY REFERENCE

This non-provisional application for patent filed in the United States Patent and Trademark Office (USPTO) under 35 U.S.C. §111(a) claims the benefit of provisional application Ser. No. 62/053,360, which was filed in the USPTO on Sep. 22, 2014, and which is incorporated herein in its entirety by reference.

The following U.S. patents are each herein incorporated by reference in their entirety: U.S. Pat. No. 7,889,046 titled CONDUCTOR ASSEMBLY FORMED ABOUT A CURVED AXIS, issued from the USPTO on Feb. 15, 2011 ("the '046 patent"); U.S. Pat. No. 7,880,578, titled CONDUCTOR ASSEMBLY INCLUDING A FLARED APERTURE REGION issued from the USPTO on Feb. 1, 2011; U.S. Pat. No. 7,990,247 titled COIL MAGNETS WITH CONSTANT OR VARIABLE PHASE SHIFTS, issued from the USPTO on Aug. 2, 2011; U.S. Pat. No. 6,921,042 titled CONCENTRIC TILTED DOUBLE-HELIX DIPOLES AND HIGHER-ORDER MULTI-POLE MAGNETS, issued from the USPTO on Jul. 26, 2015; and U.S. Pat. No. 7,893,808 titled CONDUCTOR ASSEMBLY HAVING AN AXIAL FIELD IN COMBINATION WITH HIGH QUALITY MAIN TRANSVERSE FIELD issued from the USPTO on Feb. 22, 2011.

Also incorporated by reference herein in its entirety is U.S. patent publication US 20090251257 A1, published by the USPTO on Oct. 8, 2009, titled WIRING ASSEMBLY AND METHOD OF FORMING A CHANNEL IN A WIRING ASSEMBLY FOR RECEIVING CONDUCTOR AND PROVIDING SEPARATE REGIONS OF CONDUCTOR CONTACT WITH THE CHANNEL.

STATEMENT REGARDING FEDERALLY SPONSORED RESEARCH OR DEVELOPMENT

Not applicable.

INCORPORATION-BY-REFERENCE OF MATERIAL SUBMITTED ON A COMPACT DISK

Not applicable.

BACKGROUND OF THE INVENTION

1. Field of the Invention

The present invention relates to conductor assemblies and methods of forming both wiring assemblies and systems incorporating conductor assemblies which, when conducting current, generate a magnetic field or which, in the presence of a magnetic field, induce a voltage. Such wiring, or conductor, assemblies may be components used in systems that rely on the generation of large and uniform magnetic fields.

2. Background Art

It is of continued importance across many sectors of the world economy (e.g., research and development, medical applications, rotating machines, and the like) to achieve improved performance in magnetic conductor assemblies. Development of new and improved commercial applications is dependent on an ability to create large and uniform magnetic fields. Advancements are also needed in numerous performance and reliability factors to realize commercially useful embodiments in medical, industrial and commercial applications. For example, it is desirable to make charged particle therapy cancer treatment (e.g., proton and carbon therapy) more available to patients, but these systems require cyclotrons that utilize very large magnets to steer beams of high energy charged particles. System size and cost severely limit the availability of these applications. Currently, the gantries used for proton therapy treatment rooms may extend multiple stories in height and weight over one hundred tons. One impediment to further deployment of these and other charged particle beam systems is the size and cost of the beam acceleration and focusing equipment.

Numerous magnet applications require provision of a magnetic field on the inside or the outside of a cylindrical structure with a varied number of magnetic poles. Examples of such applications are use of magnets for charged particle beam optics such as used in particle accelerator applications, particle storage rings, beam lines for the transport of charged particle beams from one location to another, and spectrometers to spread charged particle beams in accord with particle mass. Magnets of various multipole orders are needed for charged particle beam optics. In such charged particle beam applications dipole magnets are needed for steering the particle beam, quadrupoles are needed for focusing the beam, and higher order multipole magnets provide the optical equivalent of chromatic corrections.

Field errors (i.e., deviations from the ideal field strength distribution for a given application) in such systems are known to degrade the performance of the beam optics, leading to a rapid increase in beam cross sections, or beam loss within the system. Analogous to light optical systems, for which the lenses conform to predefined geometries and are ground accordingly with very high precision to render satisfactory resolution of the transmitted image, optimal performance of magnets in charged particle beam systems is dependent on creation of optimal positioning of conductor in winding configurations. This includes achievement of mechanical tolerances which result in very close conformity of the fabricated systems with predefined configurations to achieve necessary field uniformity. This is recognized for a variety of magnet designs, including double helix magnets and saddle coil magnets. See, for example, the following patent applications, each now incorporated herein by reference: U.S. 2009/0251257 filed Apr. 2, 2008, U.S. Pat. No. 7,992,884 filed Jun. 5, 2008 and PCT/US 2013/73749.

Numerous winding configurations for single-helix, double-helix, saddle coil and other conductor configurations can be manufactured by machining grooves into composite or metallic support structures, into which a conductor is inserted and, as needed, bonded into place with appropriate adhesives. The machined grooves precisely define the conductor layout of the winding and simultaneously stabilize the conductor mechanically to counteract Lorentz forces that act within the coil windings. Winding configurations of the types mentioned above, as well as the embodiments disclosed herein, typically surround a cylindrical aperture, with the conductor inserted into machined grooves to follow a 3-dimensional space curve.

The current-carrying conductor configurations used for charged particle beam optics are typically of cylindrical shape, with the conductors surrounding a tube, also of cylindrical shape. During operation, the tube is evacuated and a particle beam of narrow width passes along the central axis of the tube. The field-generating winding configurations for such applications, in most cases, consist of multiple saddle shaped layers of winding. Each layer comprises multiple turns of winding as shown in FIGS. 1A and 1B of PCT/US 2013/73749 (the '749 application), and the shape of the saddle coil winding closely matches the shape of the cylindrical beam tube. Except as disclosed in the '749 application, such saddle-shaped winding configurations for generating magnetic fields with a given pole number have typically been produced by winding the conductor over itself and around a central island. In an embodiment, the present invention contemplates a saddle coil conductor configuration and placement of the conductor in grooves as described in the '749 application.

The present invention is based, in part, on recognition that definition of the conductor configuration in, for example, a saddle coil magnet (i.e., the conductor path) and accuracy of conductor placement in the winding configuration are critical to acquiring satisfactory or optimal field uniformity, especially in the case of large magnets (e.g., magnets having lengths on the order of about 15 m) and in the case of superconducting windings. With recognition that numerous applications of magnetic fields, in addition to those related to charged particle beam optics, have potential for improved performance based on improved field uniformity, practical limitations in conventional fabrication processes may adversely affect field uniformity or limit magnet size. Field uniformity may be compromised by limitations in the fabrication process when the required magnetic coils are several meters long, as is often required for coil structures. Examples of magnets requiring large coil lengths are the bending magnets used in large accelerators like the Large Hadron Collider (LHC) near Geneva, which includes magnets having lengths of about 15 m. However, due to superior winding support and field quality achievable with machined grooves, such coil configurations of the types disclosed in the '749 application are best suited for future high field accelerator magnets having field strengths on the order of 16 to 20 Tesla.

The present invention provides a method of manufacturing and assembling segmented support structures for conductor assemblies and magnets, including magnets comprising coil windings which are multiple meters in length. The support structure into which the machined grooves are formed to define the conductor path may consist of a composite material or may be a metal in the shape of a cylinder, but which need not be manufactured in the form of a single piece of stock. Rather, the support structure may be formed in multiple connectable support structure segments. The plurality of segments includes multiple individual segments, each of sufficient length to support multiple individual coil turns in a helical or other desired conductor configuration. When the segments are connected, a contiguous desired conductor configuration, which may, for example, be helical, is formed and continues without interruption from connectable segment to connectable segment.

In the long term, for charged particle therapy and certain other high magnetic field applications, it is likely that superconducting magnets will be preferred over resistive magnets. Generally, superconducting magnets offer very stable and high field strengths and can be substantially smaller in size than resistive magnets. Moreover, the power demands of superconducting magnets are very low. However, the opportunity to provide superconducting magnets in new applications may be compromised because of the well-known quenching phenomenon. When the superconducting material undergoes an unexpected and rapid transition to a normal, non-superconducting state this can result in rapid formation of a high temperature hot spot which can destroy a magnet. Designs which improve reliability have been costly. Cost is a major constraint to greater commercialization of conventional superconducting magnet technologies which rely on saddle or racetrack coils. Moreover, for a given set of operating conditions, significant design efforts must be employed to achieve requirements of field uniformity and to assure that quenching does not occur during normal system use.

Whether future systems employ resistive or superconductive windings, a need will remain to improve design efficiency, reliability and field quality. In order to deploy carbon-based systems for charged particle cancer treatment, for example, the use of superconducting magnets may be imperative in order to meet the bending requirements of the high energy carbon beam. Coil segments used to bend beams are very complex to manufacture and must be very stable in order to implement a curved trajectory. Further, it is very difficult to apply conventional geometries, e.g., saddle coil and race track configurations, to curvilinear applications in an easily manufacturable manner and still meet requirements for field configurations.

Thus there exists a need for an easily manufacturable conductor assembly to be utilized in magnetics applications, that will support the manufacture and assembly of any winding or conductor configuration.

BRIEF SUMMARY OF THE INVENTION

The present invention provides a segmented wiring support structure and method of manufacturing and assembling conductor assemblies for magnets, including magnets comprising coil windings which may be multiple meters in length, that provide an easier and lower cost method of manufacture that the designs and methods of the prior art.

In an embodiment, the support structure of the invention comprises a cylinder in which machined grooves are formed in segmented support structures to define the conductor path. The conductor path may be any configuration such as helical, saddle coil or otherwise. The segments may be manufactured of a composite material or a metal in the shape of a cylinder having an inner diameter, an outer diameter and an axis, but which need not be manufactured from a single piece of material. Rather, the support structure may be formed in multiple connectable segments which, when connected together, form a completed wiring support structure. In an embodiment supporting a helical conductor configuration, each support segment structure may be of sufficient length, for example, to support multiple individual conductor turns in a helical configuration. When the segments are connected the helical configuration continues without interruption from connectable segment to connectable segment. The segmented wiring support structure of the invention may be applied to linear magnet geometries, curved magnet geometries or a combination of linear and curved magnet geometries. Multiple concentric layers of conductor configurations may be formed in which each layer of conductor is in grooves in segmented support structures comprising a cylinder, wherein each cylinder is concentrically disposed about an axis. Thus each cylinder has an axis, and the axes of the cylinders formed by the segmented supported structures are coaxially disposed. In this manner any number of layers of conductor configurations may be supported by the segmented structures of the invention.

In accordance with one embodiment of the present invention, the invention comprises a wiring support structure that is formed in discrete wiring support elements which may be individually manufactured and the joined together to form a completed wiring support of a desired geometry.

Embodiments of multi-segment configurations of the invention include mass produced cylindrically shaped segments and multi-layer structures comprising concentrically positioned cylindrical segments residing in different cylindrical planes about a central axis. Multi-layer structures may include spaced-apart rows of helically wound conductors where the winding may spiral around a central axis or may spiral within a cylindrical surface.

Mass production methods may be used to fabricate the support structure segments of the invention. The support structure segments of the invention may be molded, for example, of a resin composite material. Likewise the support structure segments of the invention may be cast, for example, of a metal material. For metallic support structures there may be a segmentation into very short segments like transformer laminations which are stamped and united to produce the basic shape of each segment.

Another application, for which segmentation of a coil structure into shorter sections is of substantial advantage, is for bent, or curved, magnets, which have an axis that is curved, or for which a portion of the axis is curved, as depicted in U.S. Pat. Nos. 7,889,046 and 7,880,578. While it is possible to rotate a bent support structure in order to machine the conductor support grooves in a surface of the support structure, this becomes more and more difficult for bends or curves that extend beyond angles much larger than 45 degrees. The segmented wiring support structure and method of manufacturing and assembling conductor assemblies of the invention allow a linear or curved conductor support structure to be fabricated in segments, making manufacturing much easier. As an example, in the case in which a curved magnet extends to an arc of 360 degrees, identical segments of, for example 30 degree arcs, could be fabricated using the segmented wiring support structure and method of manufacturing and assembling conductor assemblies of the invention, making manufacturing much easier.

The segmentation of a conductor support structure as is a feature and object of the invention that is applicable to any conductor configuration such as, for example, helix, multi-layer helix, saddle coil, and any other desired conductor configuraion. For curved conductor structures comprising multi-layer windings, winding segments of different layers are in the form of concentric shapes having a constant radius of curvature. This permits each outer level of support structure segments to be positioned about, e.g., to slide over in a sliding engagement, an inner level of support structure segments. This arrangement may form a series of co-axial multi-layer segments. Several large multilayer segments, each comprising sections, may have different radii of curvature. When connected in series the segments can provide a path of variable curvature.

The present invention overcomes the shortcomings of the prior art in that it enables manufacturing of wiring support structures that heretofore were either difficult or impossible to manufacture and produce.

BRIEF DESCRIPTION OF THE DRAWINGS

FIG. 5B depicts a rectangular groove cross section, and a single conductor disposed in the groove.

DETAILED DESCRIPTION OF THE INVENTION

Figure 1A:
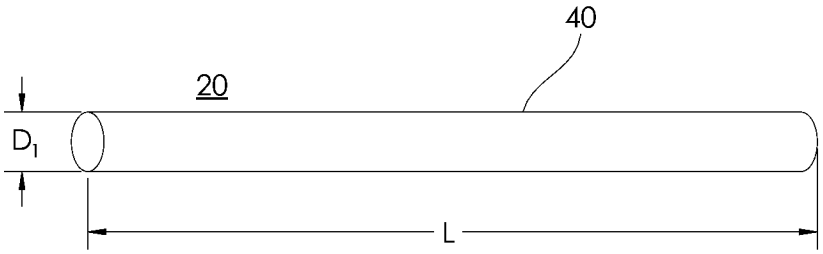
FIG. 1A depicts a segmented wiring structure of the invention adapted to a linear magnet geometry.

The present invention provides a method of manufacturing magnets, including magnets comprising coil windings which are multiple meters in length. In one embodiment, the support structure into which the machined grooves are formed to define the conductor path may consist of a composite material or a metal in the shape of a cylinder, but which need not be manufactured in the form of a single piece of stock. Rather, the support structure may be formed in multiple connectable segments. The plurality of the segments include multiple individual segments, each of sufficient length to support multiple individual coil turns in a helical configuration. When the segments are connected the helical configuration continues without interruption from connectable segment to connectable segment.

As used herein, the terms coil, spiral, helix and helical include but are not limited to regular geometric patterns. In addition, the terms coil, spiral and helix include configurations wherein a width (e.g., along the axial direction) or a thickness (e.g., along a radial direction or transverse to the axial direction) may vary. Further, terms such as winding, helical winding, wiring pattern and coil configuration as applied to physical embodiments formed of various conductor and/or insulative materials, are used without regard to how the materials are formed in place. That is, although it is conventional to physically wind a strand of conductor in the configuration of a spiral, the foregoing terms as used herein refer to the resulting configuration and not the methodology used to form the pattern. So, for example, a coil or winding may be formed from a cylindrical body by removal of body material, this resulting in a shape that corresponds to a spiral winding. In addition, the void resulting from the removal of material may also correspond to a spiral shape.

With coils helically-wound about an axis to produce magnetic field components transverse to the axis, cancellation of axial field components can be effected by the formation coils in concentrically positioned pairs having opposite tilt angles, this sometimes resulting in a high quality transverse field, e.g., a uniform dipole with essentially no higher order components. See, for example, Goodzeit et al., "The Double-50 Helix Dipole-A Novel Approach to Accelerator Magnet Design", IEEE Transactions on Applied Superconductivity, Vol. 13, No. 2, June 2003, pp. 1365-1368, which describes analytics for a double helix magnet geometry, incorporated herein by reference in its entirety. See, also, U.S. Pat. No. 6,921,042 incorporated herein by reference in its entirety.

Conductor assemblies used for magnets preferably comprise channels, or grooves, in which one or more conductors may be disposed. The formation of grooves into which a conductor is inserted provides precise conductor positioning and stabilization while also isolating portions of the conductor from other portions of the conductor. The channel profile is not limited to accommodating round wire or cables. Other conductors having square or rectangular shapes in cross section, or tape, can be used in conjunction with channels. The channel may have a cross section be configured to match the cross sectional shape of the conductor. The conductor pattern and the corresponding channel path can be formed in a relatively tight helical configuration wherein the advance per turn in an axial direction is so small that portions of the conductor in adjacent turns come very close or into contact with one another. In embodiments where contact between adjacent portions of conductor turns is a concern, the conductor has an insulative coating. As used herein, "channel" and "groove" are used interchangeably.

When the channels accommodate square or rectangular cross sectional shapes of conductor, including tape, to minimize deformation in conductor, e.g., twisting, a helical channel can be formed at a variable angle with respect to a central axis, which may be the axis of the wiring supporting structure, or reference surface. In such embodiments, the resulting field will differ from that which is generated for a conventional conductor of circular cross sectional shape. A channel for a circular shaped conductor will not follow the same path as a channel formed at such variable angle to accommodate a rectangular shaped conductor without shape deformation.

The term "conductor" as used herein refers to a string-like piece or filament of relatively rigid or flexible material, commonly referred to as cable or wire, being of the type comprising either a single conductive strand or multiple ones of such strands grouped together as one functional conductive path. The term multi-strand conductor refers to such a conductor formed as a single identifiable unit and composed of multiple conductive strands which may be twisted, woven, braided or intertwined with one another to form an identifiable single unit of wire. Multi-strand conductor may take the form of conductor that embodies a circular or a non-circular cross section. Conductors may be superconducting.

The term cross section refers to a section of a feature, e.g., of a conductor or an aperture or a coil, taken along a plane which is transverse to a definable axis through which the feature extends. If the coil row axis is curvilinear about a point of interest on the axis, the plane along which the cross section is taken is understood to be transverse to the direction of a vector which is tangent to the direction of the axis at the point of interest.

Figure 1B:
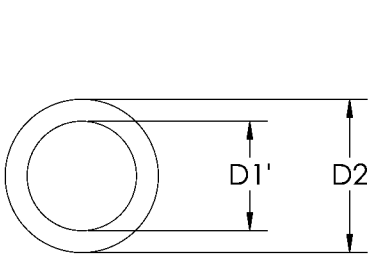
FIG. 1B depicts a single wiring structure segment of the invention adapted to a linear magnet geometry.
Figure 1B:
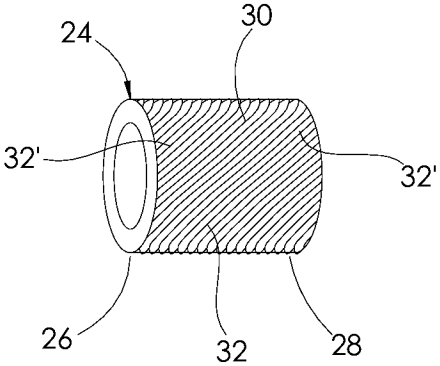

Referring now to FIGS. 1A-1D, a linear embodiment of an inner segmented wiring support structure of a two later embodiment of the invention is depicted, showing stages of assembly for construction of a segmented wiring support structure 10 of any desired length L along a support structure. As shown in FIG. 1A, a center tube 20 having an outer surface 40 is provided having a length at least as long as the desired coil length, L, and an outside diameter D1. Center tube 20 may be fabricated from stainless steel or aluminum, and may have a central opening along its axis through which, for example, a charged particle beam travels. The exemplary segmented support structure 22 shown in FIG. 1D comprises a series of identical cylindrically shaped inner support structure segments 24 each having first and second opposing end faces 26 and 28 as shown in FIG. 1B. The first level sections 24 each have an inside diameter D1' substantially equal to or slightly larger than D1 and an outside diameter D2. The inner support structure segments may, as shown, each be identical in length, $L_i$, or may vary in length.

Still referring to FIGS. 1A-1D, although center tube 20 and the cylindrically shaped inner support structure segments 24 are depicted as straight, i.e. linear, sections, this is not necessary, as the tube 20 and the sections 24 may have an axis a portion of which is curved (e.g., having a constant radius of curvature to vary direction of a beam path) as is further depicted in FIGS. 3A, 3B, 4A, 4B, and 4C. The curved axis may take any curvilinear or complex shape and is therefore not necessarily an arc segment of constant radius. Each of the inner support structure segments 24 may be identical, or may be of varying length L. Further, to accommodate straight sections and curved sections, multiple sections 24 may be provided that include combinations of straight sections and one or more sections of different curvature. In this manner a segmented wiring support structure having both straight and curved sections may be assembled. The inner support structure segments 24 may be joined to one another by any means known in the art after being placed over center tube 20, such as, for example, chemical bonding, threaded fasteners, compressed together using end plates assembled onto tube 20, or other mechanical means for holding a plurality of inner support structure segments 24 together.

FIG. 1A depicts a center tube 20 of a segmented support structure of the invention.

As shown in FIG. 1B, each of the inner support structure segments 24 includes a groove segment pattern 30 for one or more conductors, the grooves comprising a plurality of grooves, which may be a series of full groove turns 32, for placement of a conductor therein according to a predefined desired inner conductor layer configuration, which may be helical or spiral about the axis, or may be a saddle coil configuration. The groove pattern 30 on each inner support structure segment 24 may also include, adjacent each end face 26 and 28, a number of partial groove turns 32' of varied length for placement of at least one conductor therein according to a predefined helical, spiral, saddle coil, or other inner conductor layer configuration. The partial groove turns 32' are portions of full groove turns which extend from one inner support structure segment 24 to an adjoining inner support structure segment 24. When the inner support structure segments 24 are joined together, for example in a sliding engagement in which the inner diameter D1' of the inner support structure segments 24 is in a sliding engagement with the outer diameter D1 of surface 40 of center tube 20, the partial groove turns 32' match to partial groove turns 32' in an adjoining inner support structure segment, forming a contiguous inner support structure groove path, which may be any desired inner conductor layer configuration such as helical, spiral or saddle coil, about the inner support structure segment axis in a predefined configuration along the coil length L.

Figure 1C:
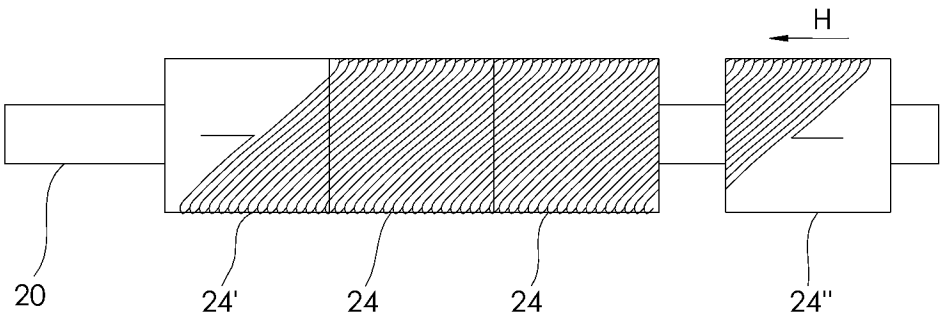
FIG. 1C depicts a segmented wiring structure of the invention adapted to a linear magnet geometry, showing the assembly of a wiring structure segment.
Figure 1D:
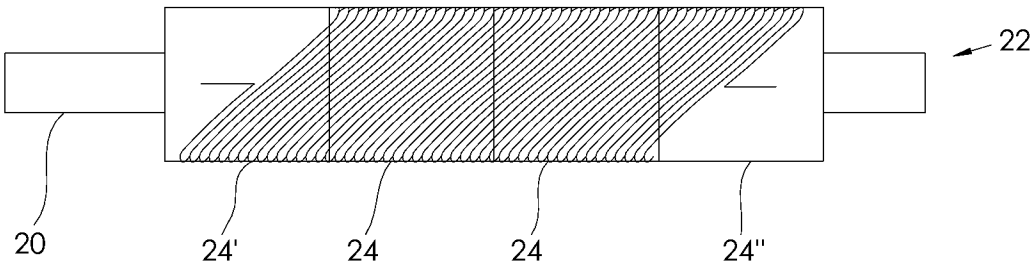
FIG. 1D depicts an assembled segmented wiring structure of the invention adapted to a linear magnet geometry.

Referring next to a view of a partially assembled segmented support structure of FIG. 1C, three of the cylindrically shaped inner support structure segment 24 are shown installed on tube 20 by, for example, sliding each section 24 over tube 20 in a sliding engagement between the inner diameter D1' of the inner support structure segments 24 and the outer diameter D1 of surface 40 of center tube 20. Also shown is a fourth inner support structure segment 24' moving into position in the sliding engagement with center tube 20 in the direction of arrow H, and placing adjacent ends 26 and 28 of different inner support structure segments 24 against one another to provide an extended surface of diameter D2 which is at least as long as a desired coil length, L, and forming a contiguous inner support structure groove path, which may be any configuration such as helical or saddle coil, in the outer diameter of the assembled inner support structure 22. As all of the inner support structure segments 24 are assembled on the tube 20, the partial groove turns 32' along adjoining end faces 26 and 28 of each pair of adjacent inner support structure segments 24 are aligned with one another to create complete groove turns. This results in one continuous groove 36 along all of the installed inner support structure segments 24, extending the full length, L, in accord with a predefined inner conductor layer configuration that may, for example, be helical, spiral, saddle coil or any other configuration.

The full groove turns 32 and partial groove turns 32' of the inner support structure segments 24 shown in FIG. 1C are all positioned along a common cylindrical outer surface 38 having a radius equal to one half the outside diameter D2. Formation of groove turns in discrete inner support structure segments 24 is to be contrasted with other embodiments, such as disclosed in U.S. Patent Application 2009/0251257 wherein each of multiple layers a pattern of groove turns is machined into a length of resin composite material which extends the full coil length. Such layers are each sequentially formed, are then machined to create a continuous groove and before a next layer is formed the conductor material is placed in the groove. Employing the fabrication methods taught in U.S. patent publication 2009/0251257 in the present invention, inner support structure segments 24 may also be formed with a resin composite material in a like manner to that that described at paragraphs [0024]-[0026] and FIG. 1 in U.S. patent publication 2009/0251257. With the inner diameter D1' of the inner support structure segments 24 substantially equal to or slightly larger than the outside diameter D1 of center tube 20, each inner support structure segment 24 can be slidingly positioned over and about the tube into a desired position. Also, in an embodiment in which the inner support structure segments 24 are formed of a resin composite material, the outer surface 40 of the tube 20 can be coated with resin prior to installing the sections about the tube 20 so that upon curing of the resin the individual inner support structure segments 24 become locked in place with a permanent attachment.

In an alternate method of assembly, the inside diameter D1' of each inner support structure segment 24, which may be formed of a resin composite material, may be substantially equal to the outside diameter D1 of center tube 20. Prior to installation of each inner support structure segment 24 over center tube 20, a temperature differential may be created between the tube 20 and the inner support structure segments 24 that sufficiently reduces the outside diameter D1 of center tube 20 relative to the inside diameter D1' of the inner support structure segments 24 in order to enable each inner support structure segment 24 to slide over center tube 20 into a desired position, and permit alignment of adjoining partial groove turns 32' along abutting end faces 26 and 28 of adjacent inner support structure segments 24. Once installation is complete, and center tube 20 and inner support structure segments 24 come into thermal equilibrium, the diameters D1 and D1' again become substantially equal or a slight press fit, locking center tube 20 and inner support structure segments 24 together. The temperature differential between the tube 20 and the inner support structure segments 24 may, for example, be created by active chilling of center tube 20 prior to or during the assembly process. In this manner, an assembled inner support structure 22 of the invention may be fabricated and assembled having a contiguous groove of a desired inner conductor layer configuration, for example helical, saddle coil or otherwise as may be desired by a user, along its outer diameter.

Figure 2A:
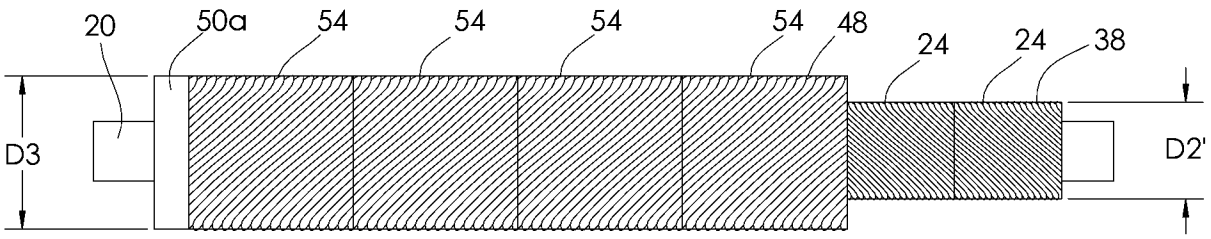
FIG. 2A depicts a multilevel partially assembled segmented wiring structure of the invention adapted to a linear magnet geometry.
Figure 2B:
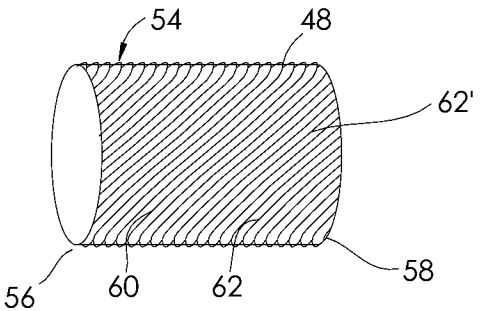
FIG. 2B depicts a single wiring structure segment of the invention adapted to a linear magnet geometry.
Figure 2C:
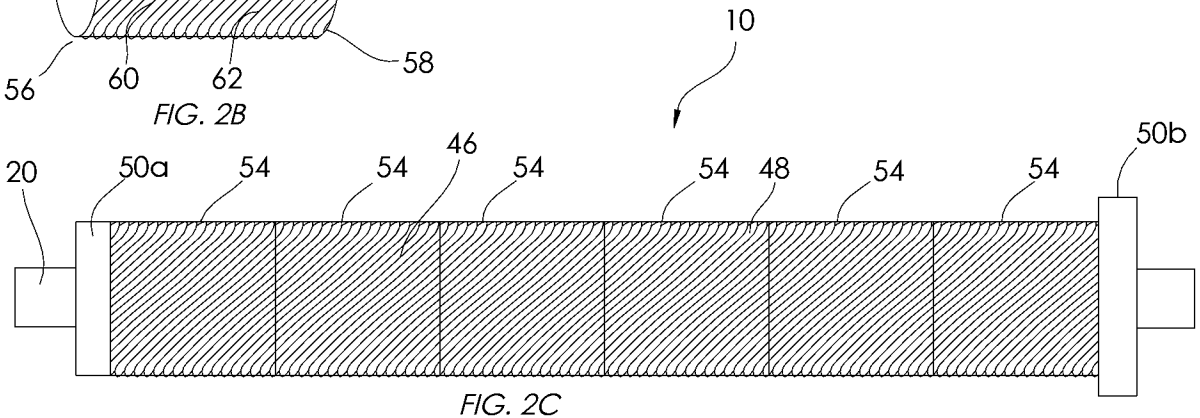
FIG. 2C depicts a multilevel assembled segmented wiring structure of the invention adapted to a linear magnet geometry.

Referring now to FIGS. 2A-2C, a sequence of assembly steps for a segmented wiring support structure 10 of the invention is depicted in which at least one optional additional groove 46 is formed radially outward from and about the groove 36, i.e., along an outer surface 48 in a second cylindrical surface which is formed on an outer diameter of outer support structure segments 54 and which is concentric with the cylindrical surface 38 which is formed on an outer diameter of outer support structure segments 24. As shown in an embodiment in the partially assembled wiring support structure 10 in FIG. 2A, a continuous segment of preferably splice-free conductor 38 is first positioned in the continuous groove 36 formed on the outer diameter of assembled inner support structure 22 and then is extended into the groove 46 along one of two discrete shoulder regions 50*a*, 50*b*. One shoulder region 50*a*, schematically indicated in FIG. 2A, provides an inter level transition ramp for splice free conductor extending from the groove 36 to the groove 46, such as described in U.S. Patent Application 2009/0251257 at paragraphs [0030] through [0037], which teachings can be readily applied to fabrication of the coil structure 10 as a multi-layer conductor structure. A plurality of identical cylindrically shaped outer support structure segments 54 each having first and second opposing end faces 56 and 58 all have an inside diameter D2', substantially equal to or slightly larger than outer diameter D2 of inner support structure segments, and an outer diameter D3. The outer support structure segments 54 may each be identical in length or may vary in length.

Still referring to FIGS. 2A-2C, each of the outer support structure segments 54 includes a groove segment pattern 60 comprising a series of full groove turns 62 for placement of conductor therein according to a predefined outer conductor layer configuration, which may be helical, spiral, saddle coil or any other desired configuration. The groove pattern 60 on each outer support structure segment 54 also includes, adjacent to each end face 56 or 58, a number of partial groove turns 62' of varied length for placement of conductor therein according to a predefined outer conductor layer configuration. The partial groove turns 62' are portions of full groove turns which extend from one outer support structure segment 54 to an adjoining outer support structure segment 54 to provide the complete predefined outer conductor layer configuration in outer surface 48 along the coil length, L.

Still referring to FIGS. 2A-2C, the cylindrically shaped outer support structure segments 54 are assembled onto the installed inner support structure segments 24 by, for example, sliding each outer support structure segment 54 over one or more of the inner support structure segments 24 in a sliding engagement between the inner diameter D2' of outer support structure segments 54 and the outer diameter D2 of the inner support structure segments 24 in a sliding engagement, and placing adjacent end faces 56 and 58 of different outer support structure segments 54 in contact with one another to provide an extended surface 48, of diameter D3, which is at least as long as the desired coil length, L, and forming an contiguous outer groove about the outer support structure segments axis, which outer groove may be helical, spiral, saddle coil or any other desired configuration.

Still referring to FIGS. 2A-2C, as all of the outer support structure segments 54 are assembled onto the inner support structure segments 24 in a sliding engagement, the partial groove turns 62' along adjoining end faces 56 and 58 of each pair of adjacent outer support structure segments 54 are aligned with one another to create complete groove turns in the groove segment pattern 60, forming a contiguous outer groove about 46 about the axis along all of the installed outer support structure segments 54, extending the length L, in accord with the predefined conductor configuration which may be helical, spiral, saddle coil or other configuration when said outer support structure segments 54 are disposed in contact with one other and the adjacent end faces 56 and 58 of each pair of adjacent outer support structure segments 54 are in contact. FIG. 2C illustrates the coil structure 10 having six exemplary outer support structure segments 54. The six sections 54 are installed on six inner support structure segments 24, but the end faces 56 and 58 of the outer support structure segments 54 may be staggered with respect to the inner support structure segments 24.

Still referring to FIGS. 2A-2C, the depicted second level outer support structure segments 54 may include a series of full groove turns 62 and partial groove turns 62' all positioned along a common cylindrical surface 48 having a radius equal to one half the outside diameter D3. As noted for the inner support structure segments 24, this is to be contrasted with other embodiments, such as disclosed in U.S. patent publication 2009/0251257, having multiple layers of resin composite material formed, one over another, to create a multi-level coil. Employing the fabrication methods taught in U.S. 2009/0251257, the individual outer support structure segments 54 may be formed with a resin composite material in a like manner to that that hereinbefore described for the inner support structure segments 24. With the inside diameters D2' of the outer support structure segments 54 slightly larger than the outside diameters D2 of the inner support structure segments 24, each outer support structure segments 54 can be slidingly positioned over and about the inner support structure segments 24 and into a desired position. Also, in an embodiment in which the outer support structure segments 54 formed of a resin composite material, the outer surfaces 38 of the inner support structure segments 24 can be coated with resin prior to installing the outer support structure segments 54 about the inner support structure segments 24 so that, upon cure of the resin, the individual second level sections 54 become locked in place about the first level sections 24.

With this arrangement, assembly of a segmented support structure of the invention may comprise any number of layers of concentric support structures concentrically positioned about ceneter tube 20 and coaxial thereto0. Thus, the segmented support structure of the invention 10 may have a single groove 36 or multiple grooves formed in any desired number of concentric cylindrical layers. Further, each of the grooves may be of sufficient depth to stack multiple conductors in a single groove, resulting in multiple coils, as described in FIG. 8 of PCT/US2013/73749. A magnet comprising the segmented support structure of the invention may therefore comprise any number of layers of segmented support structures, each layer comprising a contiguous groove for holding a conductor, the groove comprising any desired configuration such as helical, spiral, saddle coil or otherwise. It is not necessary that each layer comprise similar groove configurations as the other layers.

Referring to FIGS. 1A-1D and FIGS. 2A-2C, an embodiment of the segmented wiring support structure of the invention may comprise a center tube 20 having an outer diameter and an axis; a plurality of inner support structure segments 24 each having an inner diameter and an outer diameter; and a plurality of outer support structure segments 54 each having an inner diameter and an outer diameter. Each of the inner support structure segment 24 inner diameters may be slidingly engaged with the center tube 20 outer diameter, and each of the inner support structure segment outer diameter may comprise a plurality of grooves 32 and 32'; and wherein each of said outer support structure segment inner diameters is slidingly engaged with an outer diameter of one or more of said inner support structure segments, and each of said outer support structure segment outer diameters comprises a plurality of grooves 46, 60, 62 or 62'. The plurality of grooves of the plurality of inner support structure segments together form a contiguous inner helical groove about the axis when the support structure segments are disposed in contact with one other, and the plurality of grooves of said plurality of outer support structure segments together form a contiguous outer helical groove about said axis when said support structure segments are disposed in contact with one other.

An embodiment of the invention has been illustrated for helical coil designs, including double helix designs and single helix designs as described in U.S. Pat. Nos. 6,921,042 and 7,893,808. The invention may also be practiced by using saddle coil conductor configurations such as described in PCT/US2013/73749, including embodiments where none of the segments incorporate complete turns and not all segments are identical. Thus the invention is not limited to a specific conductor geometry such as saddle coil, single helix, or double helix configurations. For example, a series of identical segments may be provided for mounting about a tube structure to construct the straight sections of multiple saddle coil winding configurations in a dipole or quadrupole or higher order design, while segments providing portions of the curved paths may contain differing groove patterns.

Although exemplary embodiments have been described, numerous variants are included within the scope of the claims. For example, the segments which form each groove pattern (e.g., segments 24 and 54) may be formed of two half cylinder portions that are placed about an inner structure such as tube 20. In this embodiment, the half cylinder portions forming the inner and outer support structure segments in the case of a two layer segmented support structure may be joined by any means known in the mechanical arts such as, for example, and not by way of limitation, chemical bonding, threaded fasteners or other attachment means.

A support structure 22 has been illustrated as comprising a series of identical cylindrically shaped sections, but in other embodiments of the invention a support structure may comprise sections of differing length, curvature or groove pattern. As noted, differing sections may be assembled to form a saddle coil configuration. In another example, the segments could differ in order to vary the multi-pole order of the configuration, or to provide flared conductor assembly ends.

Figure 3A:
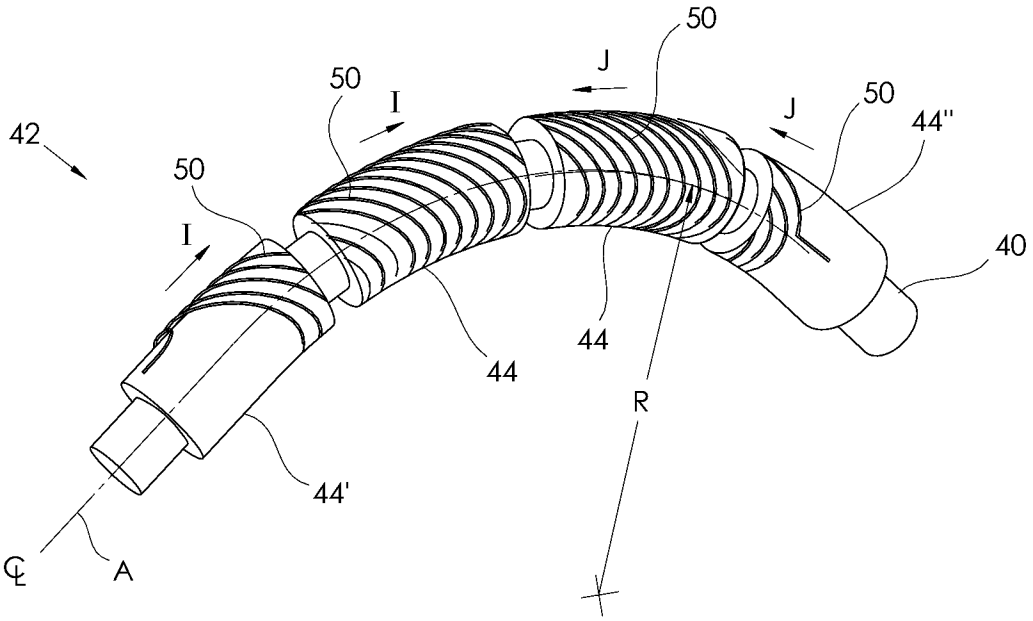
FIG. 3A depicts a segmented wiring structure of the invention adapted to a curvlinear magnet geometry, showing the assembly of a wiring structure segment.
Figure 3B:
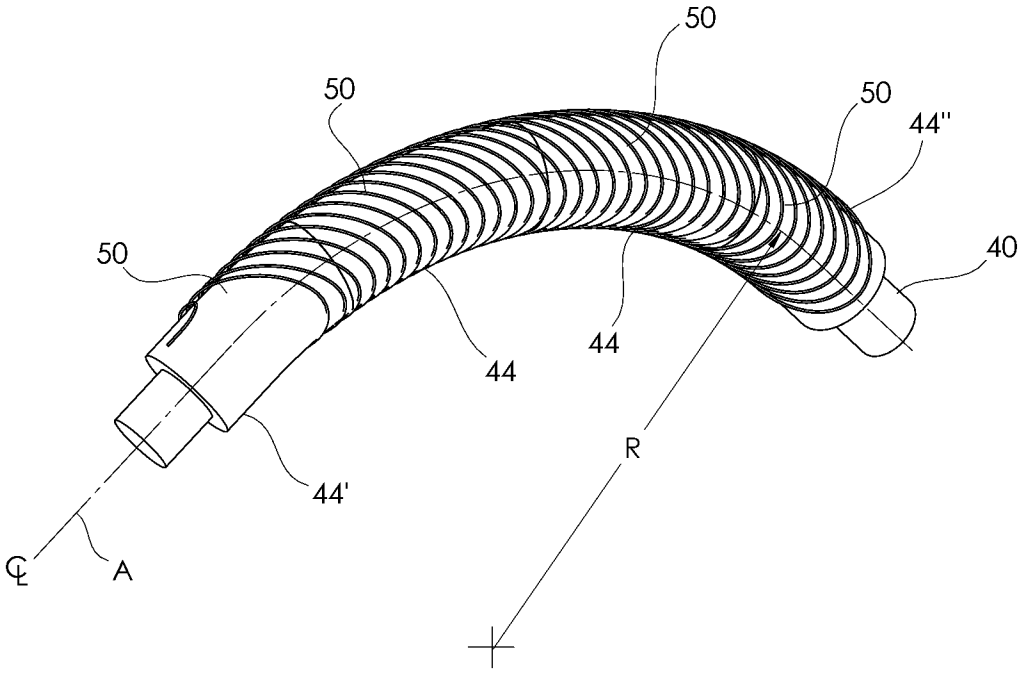
FIG. 3B depicts an assembled segmented wiring structure of the invention adapted to a curvilinear magnet geometry.

Referring now to FIGS. 3A and 3B, a curved single helix embodiment of the invention is shown in which the wiring support structure segments 44 comprise a curved axis which may, for example, have a radius R or may take any curvilinear shape, thus forming an assembled conductor assembly in which the axis is curved, or a portion of the axis is curved. Separate support structure segments 44 comprising a cylinder having a curved axis, an inner diameter and an outer diameter may be slidingly engaged with an outer diameter of tube 40 having a curved axis matching the curved axis of support structure segments 44, for example of radius R. Each of the support structure segments 44 inner diameters may be slidingly engaged with the center tube 40 outer diameter, and each of the support structure segment outer diameters may comprise a plurality of grooves 50 and 50. The plurality of grooves of the plurality of inner support structure segments together may form a contiguous inner helical groove about the axis when the support structure segments are disposed in contact with one other as depicted in FIG. 3B.

In a single helix embodiment, the segmented support structure for a helical conductor assembly of the invention may comprise a plurality of support structure segments, wherein each support structure segment is defined as a tubular shape formed about an axis, each segment having a length, and each support structure segment further comprising a first end face and a second end face, each end face transverse to said axis and wherein each support structure segment is further defined as having an outer surface defined by an outer diameter, said outer diameter of each support structure segment further comprising a plurality of grooves for containing a conductor. The plurality of grooves of the plurality of support structure segments may together form a contiguous helical groove disposed about an axis, the helical groove axis having a curved portion, when said support structure segments are disposed such that said first end faces and said second end faces of said plurality of support structure segments are in contact with one other forming a cylinder having an axis, said helical groove forming an aperture region, such that when a conductor is disposed in said contiguous helical groove, a magnetic field having multi-pole components oriented in directions transverse to the axis is capable of being sustained; wherein the aperture region extends outward from the axis a radial distance to the contiguous helical groove; and wherein a conductor contained in said contiguous helical groove capable of generating a magnetic field in the curved aperture region along a plane passing through a point along the curved segment of the contiguous helical groove; and the magnetic field along directions parallel to the plane includes a first dominant component of multi-pole order A and one or more second components each of different order than A, wherein at 80 percent of the radial distance the field contribution along the plane by each of the one or more second components is at least $10^3$ times smaller in magnitude than the magnitude of the first dominant component of order A.

Figure 4A:
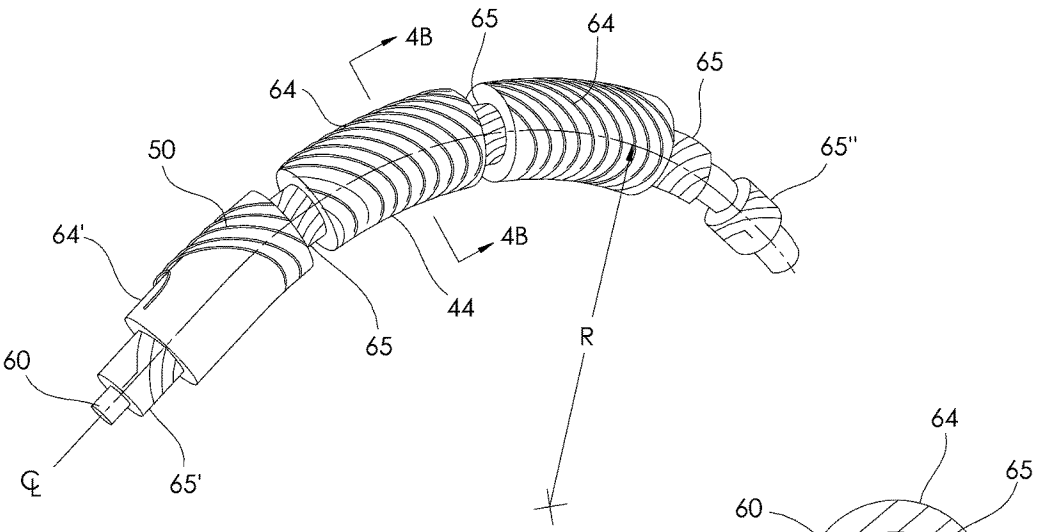
FIG. 4A depicts a multilevel partially assembled segmented wiring structure of the invention adapted to a curvilinear magnet geometry.
Figure 4B:
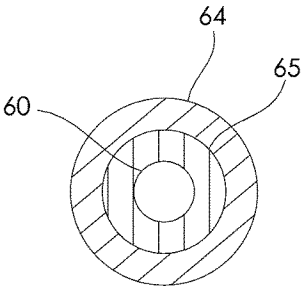
FIG. 4B depicts a cross section view of a multilevel segmented wiring structure of the invention.
Figure 4C:
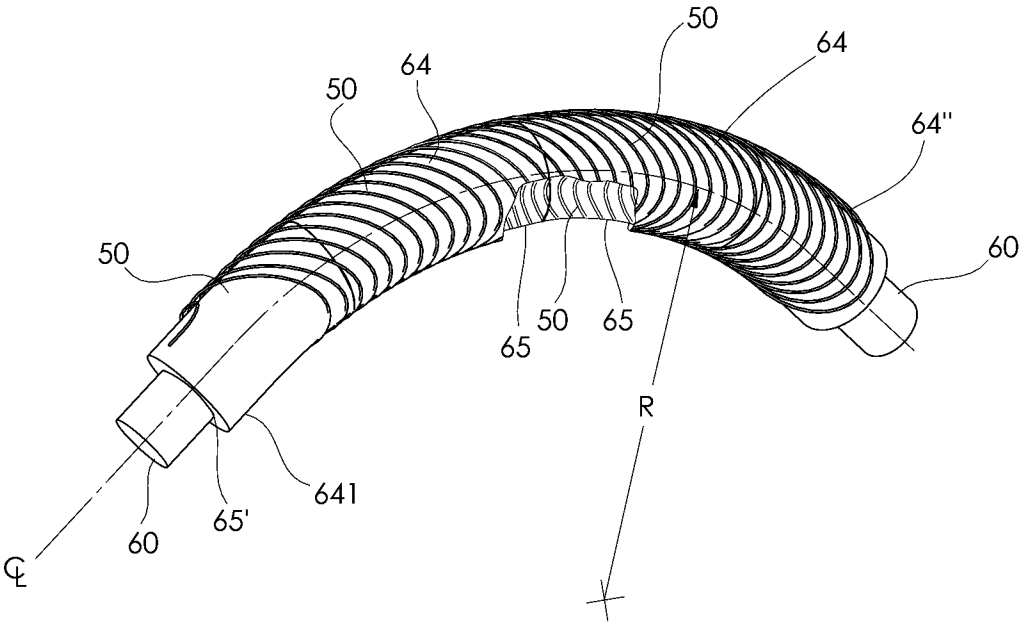
FIG. 4C depicts a multilevel partially assembled segmented wiring structure of the invention adapted to a curvilinear magnet geometry, with the outer segmented wiring structure cut away to show an inner segmented wiring structure with helical grooves running in an opposite direction to helical grooves in the outer segmented wiring structure.
Figure 3B:
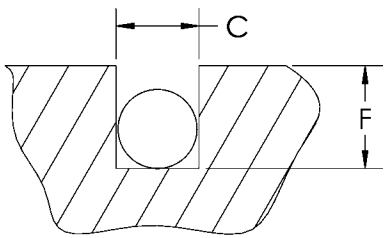

Referring now to FIGS. 4A, 4B and 4C, a curved double helix embodiment of the segmented wiring support structure may comprise a center tube 60 having an outer diameter and curved axis; a plurality of inner support structure segments 65 each having an inner diameter and an outer diameter and a curved axis; and a plurality of outer support structure segments 64 each having an inner diameter and an outer diameter and a curved axis. Each of the inner support structure segment 65 inner diameters may be slidingly engaged with the center tube 60 outer diameter, and each of the inner support structure segment outer diameter may comprise a plurality of grooves 70; and each of the outer support structure segment inner diameters may be slidingly engaged with an outer diameter of one or more of the inner support structure segments, and each of the outer support structure segment outer diameters may comprise a plurality of grooves 50. The plurality of grooves of the plurality of inner support structure segments together form a contiguous inner helical groove about the axis when the support structure segments are disposed in contact with one other, and the plurality of grooves of said plurality of outer support structure segments together form a contiguous outer helical groove about said axis when said support structure segments are disposed in contact with one other, as shown in FIG. 4C. In alternate embodiments, the inner and outer groove configurations need not be a helix configuration but may be any groove configuration for receiving a conductor or plurality of conductors as may be desired by a user.

Figure 5A:
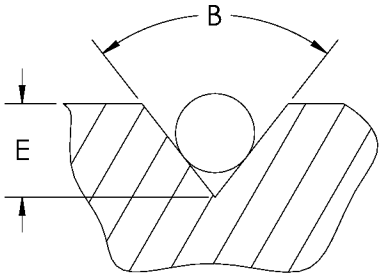
FIG. 5A depicts a V groove cross section, and a single conductor disposed in the groove.
Figure 5C:
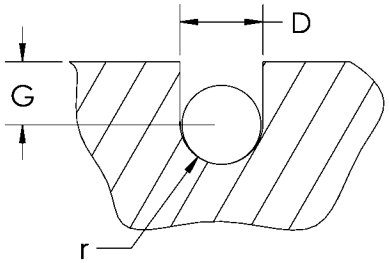
FIG. 5C depicts a rectangular groove with rounded bottom cross section, and a single conductor disposed in the groove.

Referring now to FIGS. 5A, 5B and 5C, the grooves of the wiring support structure segments may be a V-groove as in FIG. 5A, a rectangular or square groove as in FIG. 5B, a rounded bottom groove as in FIG. 5C, or any combination of these cross sectional shapes. The cross section of the grooves may alternatively be of any shape desired by user for a particular or general application. Conductors 100 may be contained with the grooves of the wiring support structure segments; multiple conductors may be contained within a single groove.

The segmented wiring support structure of the invention may form any number of coaxial conductor layers, and each conductor layer need not be of the same conductor configuration as the other conductor layers, i.e. single helix, double helix, saddle coil, or otherwise.

Although specific embodiments of the segmented wiring support structure are described and depicted in the specification, drawings, and claims, the scope of the claims includes equivalent structures and steps, and thus the scope of the invention is not to be limited to the exemplary embodiments depicted in the figures.

What is claimed is:

1. A support structure for a double layer helix conductor assembly, comprising:

a center tube having an outer diameter and a first axis;

a plurality of inner support structure segments each having an inner diameter, an outer diameter and a second axis; and a plurality of outer support structure segments each having an inner diameter, an outer diameter, and a third axis:

wherein each of said inner support structure segment inner diameters is slidingly engaged with said center tube outer diameter, and each of said inner support structure segment outer diameter comprises a plurality of grooves and each of said outer support structure segment inner diameters is slidingly engaged with an outer diameter of one or more of said inner support structure segments, and each of said outer support structure segment outer diameters comprises a plurality of grooves, such that said first, second and third axes are coaxially disposed;

wherein said plurality of grooves of said plurality of inner support structure segments together form a contiguous inner helical groove path about said first axis when said inner support structure segments are disposed in contact with one other, and said plurality of grooves of said plurality of outer support structure segments together form a contiguous outer helical groove about said first axis when said outer support structure segments are disposed in contact with one other.

2. The support structure for a double layer helix conductor assembly of claim 1, wherein said center tube is fabricated from a material selected of the group consisting of aluminum and steel.

3. The support structure for a double layer helix conductor assembly of claim 1, wherein said inner support structure segments are fabricated from a metal.

4. The support structure for a double layer helix conductor assembly of claim 3, wherein said inner support structure segments are fabricated by fabrication methods comprising casting.

5. The support structure for a double layer helix conductor assembly of claim 1, wherein said inner support structure segments are fabricated from a composite material.

6. The support structure for a double layer helix conductor assembly of claim 5, wherein said inner support structure segments are fabricated by fabrication methods comprising use of a mold.

7. The support structure for a double layer helix conductor assembly of claim 1, further comprising a first conductor and a second conductor, wherein a double layer helical conductor assembly is formed when said first conductor is disposed in said contiguous inner helical groove and said second conductor is disposed in said contiguous outer helical groove.

8. The support structure for a double layer helix conductor assembly of claim 1, wherein said contiguous inner helical groove and said contiguous outer helical groove are in opposition.

9. The support structure for a double layer helix conductor assembly of claim 7, wherein said contiguous inner helical groove and said contiguous outer helical groove are in opposition.

10. The support structure for a double layer helix conductor assembly of claim 1, wherein said axis is linear.

11. The support structure for a double layer helix conductor assembly of claim 7, wherein said first axis is linear.

12. The support structure for a double layer helix conductor assembly of claim 8, wherein said first axis is linear.

13. The support structure for a double layer helix conductor assembly of claim 9, wherein said first axis is linear.

14. The support structure for a double layer helix conductor assembly of claim 1, wherein at least a portion of said first axis is curved.

15. The support structure for a double layer helix conductor assembly of claim 7, wherein at least a portion of said first axis is curved.

16. The support structure for a double layer helix conductor assembly of claim 8, wherein at least a portion of said first axis is curved.

17. The support structure for a double layer helix conductor assembly of claim 9, wherein at least a portion of said first axis is curved.

18. A segmented support structure for a helical conductor assembly, comprising:

a plurality of support structure segments, wherein each support structure segment is defined as a tubular shape formed about an axis, each segment having a length, and each support structure segment further comprising a first end face and a second end face, each end face transverse to said axis; and wherein each support structure segment is further defined as having an outer surface defined by an outer diameter, said outer diameter of each support structure segment further comprising a plurality of grooves for containing a conductor, wherein said plurality of grooves of said plurality of support structure segments together form a contiguous helical groove disposed about an axis coaxial with said support structure segment axes when said support structure segments are disposed such that said first end faces and said second end faces of said plurality of support structure segments are in contact with one other forming a cylinder having an axis coaxial with said support structure segment axes, said helical groove forming an aperture region, such that when a conductor is disposed in said contiguous helical groove, a magnetic field having multi-pole components oriented in directions transverse to the axis is capable of being sustained;

wherein the aperture region extends outward from the axis a radial distance to the contiguous helical groove; and wherein a conductor contained in said contiguous helical groove capable of generating a magnetic field in the curved aperture region along a plane passing through a point along the curved segment of the contiguous helical groove; and the magnetic field along directions parallel to the plane includes a first dominant component of multi-pole order A and one or more second components each of different order than A, wherein at 80 percent of the radial distance the field contribution along the plane by each of the one or more second components is at least $10^3$ times smaller in magnitude than the magnitude of the first dominant component of order A.

19. The segmented support structure for a helical conductor assembly of claim 18, wherein said support structure segments are fabricated from a metal.

20. The segmented support structure for a helical conductor assembly of claim 19, wherein said support structure segments are fabricated by fabrication methods comprising casting.

21. The segmented support structure for a helical conductor assembly of claim 18, wherein said support structure segments are fabricated from a composite material.

22. The segmented support structure for a helical conductor assembly of claim 21, wherein said support structure segments are fabricated by fabrication methods comprising use of a mold.

23. The segmented support structure for a helical conductor assembly of claim 18, wherein said axis is linear.

24. The segmented support structure for a helical conductor assembly of claim 18, wherein at least a portion of said axis is curved.

* * * * *